US009658024B1

(12) United States Patent
Trpkovski

(10) Patent No.: US 9,658,024 B1
(45) Date of Patent: May 23, 2017

(54) SLING BOW

(71) Applicant: P.T. Archery LLC, Prairie Du Sac, WI (US)

(72) Inventor: Paul Trpkovski, Kailua Kona, HI (US)

(73) Assignee: P.T. Archery LLC, Prairie Du Sac, WI (US)

( * ) Notice: Subject to any disclaimer, the term of this patent is extended or adjusted under 35 U.S.C. 154(b) by 0 days.

(21) Appl. No.: 15/357,571

(22) Filed: Nov. 21, 2016

Related U.S. Application Data

(60) Provisional application No. 62/269,728, filed on Dec. 18, 2015.

(51) Int. Cl.
*F41B 3/02* (2006.01)
*F41B 5/00* (2006.01)

(52) U.S. Cl.
CPC ..... *F41B 3/02* (2013.01); *F41B 5/0094* (2013.01)

(58) Field of Classification Search
CPC .... F41B 3/005; F41B 3/02; F41B 5/00; F41B 5/10
See application file for complete search history.

(56) References Cited

U.S. PATENT DOCUMENTS 1,375,776 A 4/1921 Buys
3,949,729 A * 4/1976 Pfotenhauer ..... F41B 5/12 124/20.1
4,265,212 A 5/1981 Wolf et al.
4,373,503 A 2/1983 Saunders et al.
4,437,449 A 3/1984 Attanasio et al.
4,957,093 A 9/1990 Hamlett
5,632,262 A 5/1997 Hanson
5,762,056 A 6/1998 Kysilka et al.
7,748,369 B2 * 7/2010 Chee ..... F41B 3/02 124/20.1
8,453,630 B2 * 6/2013 Fields ..... F41B 7/00 124/20.3
2008/0295816 A1 12/2008 Edwards et al.
2012/0037137 A1 2/2012 Thurmon et al.
(Continued)

OTHER PUBLICATIONS

Bad Ass Slingbows, "Beast Slingbow Product Page," http://badasssslingbows.com/proddetail.php?prod=BAS061, retrieved Nov. 22, 2016 (1 page).

(Continued)

*Primary Examiner* — John Ricci
(74) *Attorney, Agent, or Firm* — Pauly, DeVries Smith & Deffner, LLC

(57) ABSTRACT

Embodiments include a sling bow designed to shoot a projectile. The sling bow can include a handle; a first limb comprising a distal end and a proximal end, wherein the proximal end is coupled to the handle; a second limb comprising a distal end and a proximal end, wherein the proximal end is coupled to the handle; a drawstring comprising a first elastic portion, a second elastic portion, and a non-elastic portion between the first and second elastic portions, wherein a first end of the first elastic portion is coupled to the distal end of the first limb and a first end of the second elastic portion is coupled to the distal end of the second limb; a first drawstring guide, the first drawstring guide defines a first drawstring void; and a second drawstring guide, the second drawstring guide defines a second drawstring void. Other embodiments are also included herein.

20 Claims, 17 Drawing Sheets

(56) References Cited

U.S. PATENT DOCUMENTS

| | | | | |
|---|---|---|---|---|
| 2014/0238372 | A1 | 8/2014 | Chirico et al. | |
| 2015/0176940 | A1* | 6/2015 | Cummings | F41B 7/08 124/20.3 |

OTHER PUBLICATIONS

ChiefAJ.com, "North American Big Game Edition Product Page," http://www.chiefaj.com/product-page/c27011ff-f29f-8380-45a4-f32776353c73, retrieved Nov. 22, 2016 (1 page).
Instructables.Com, "Homemade Sling-Bow," http://www.instructables.com/id/Homemade-Sling-Bow/?ALLSTEPS, retrieved Nov. 22, 2016 (13 pages).
Slingbow Industries, "Ranger Slingbow Package Product Page," http://slingbow.com/product/slingbow-starter-package, retrieved Nov. 22, 2016 (2 pages).

* cited by examiner

SLING BOW

CLAIM OF PRIORITY

This application claims the benefit of U.S. Provisional Application No. 62/269,728, filed Dec. 18, 2015, the content of which is herein incorporated by reference in its entirety.

FIELD OF THE TECHNOLOGY

The present application relates to a sling bow. More specifically, the present application relates to a quiet, compact and easy to shoot sling bow.

BACKGROUND

Archery bows and sling shots have been in existence in many forms for thousands of years. Many ancient civilizations had a variety of bows and sling shots that gave them unique features and more power. In recent years, compound bows also had many improvements to increase power, improve efficiency, balance, improve accuracy, and decrease the shock that the weapon produces during and after the shot. However, bows can be large and difficult for people to handle or travel with. Many archers that enjoy bow hunting will carry their bows for extensive distances and would prefer to carry their bows on or within backpacks. However, small bows often lack the power required by the archer. Similarly, a sling shot, while often small enough to fit within a backpack, also often lacks the power required for hunting.

SUMMARY

An embodiment described herein provides a sling bow designed to shoot a projectile. In various embodiments, the sling bow comprises a handle; a first limb comprising a distal end and a proximal end, wherein the proximal end is coupled to the handle; a second limb comprising a distal end and a proximal end, wherein the proximal end is coupled to the handle; a drawstring comprising a first elastic portion, a second elastic portion, and a non-elastic portion between the first and second elastic portions, wherein a first end of the first elastic portion is coupled to the distal end of the first limb and a first end of the second elastic portion is coupled to the distal end of the second limb; a first drawstring guide, wherein the first drawstring guide defines a first drawstring void, wherein the drawstring extends through the first drawstring void; and a second drawstring guide, wherein the second drawstring guide defines a second drawstring void, wherein the drawstring extends through the second drawstring void. In various embodiments, when the drawstring is in a non-drawn position, the drawstring is supported by the first drawstring guide and the second drawstring guide to define a brace height between the drawstring and the handle. In various embodiments, the first limb and the second limb are configured to elastically deform when the drawstring is brought into a drawn position.

In some embodiments, the sling bow can further comprise a first drawstring stop and a second drawstring stop. In various embodiments, the first drawstring stop extends from the first limb or the handle and a face of the first drawstring stop is located within a path of the drawstring when the drawstring is released from a drawn position. In various embodiments, the second drawstring stop extends from the second limb or the handle and a face of the second drawstring stop is located within a path of the drawstring when the drawstring is released from a drawn position.

In some embodiments, the first drawstring guide comprises a first roller and the second drawstring guide comprises a second roller.

In some embodiments, the first roller defines a portion of the first drawstring void and the second roller defines a portion of the second drawstring void.

In some embodiments, the first elastic portion and the second elastic portion comprise a material with a modulus of elasticity of at least 0.01 GPa and not more than 0.2 GPa.

In some embodiments, the drawstring has a length that is at least 1.5 times longer when the drawstring is in a drawn position compared to the length when the drawstring is in the non-drawn position.

In some embodiments, a limb longitudinal axis and a handle longitudinal axis form an angle of between 120 degrees and 150 degrees in a right-handed configuration of the sling bow.

In some embodiments, the first limb and the second limb comprise carbon fiber.

In some embodiments, the first drawstring guide is coupled to the handle or the first limb and the second drawstring guide is coupled to the handle or the second limb.

In some embodiments, the first drawstring void and second drawstring void are each one of the group consisting of an open channel or a closed aperture.

An embodiment described herein provides a sling bow designed to shoot a projectile. The sling bow can comprise a handle; a first limb comprising a distal end and a proximal end, wherein the proximal end is coupled to the handle; a second limb comprising a distal end and a proximal end, wherein the proximal end is coupled to the handle; a drawstring comprising a first elastic portion, a second elastic portion, and a non-elastic portion between the first and second elastic portions, wherein a first end of the first elastic portion is coupled to the distal end of the first limb and a first end of the second elastic portion is coupled to the distal end of the second limb; a first drawstring guide, wherein the first drawstring guide defines a first drawstring void, wherein the drawstring extends through the first drawstring void; and a second drawstring guide, wherein the second drawstring guide defines a second drawstring void, wherein the drawstring extends through the second drawstring void. In some embodiments, when the drawstring is in a non-drawn position, the drawstring is supported by the first drawstring guide and the second drawstring guide to define a brace height between the drawstring and the handle. In some embodiments, the first limb and the second limb each have a length, a width, and a thickness, and the length of the first limb is greater than the first limb's width and thickness, and the length of the second limb is greater than the second limb's width and thickness.

In some embodiments, the sling bow further comprises a first drawstring stop and a second drawstring stop; wherein the first drawstring stop extends from the first limb or the handle and a face of the first drawstring stop is located within a path of the drawstring when the drawstring is released from a drawn position. In some embodiments, the second drawstring stop extends from the second limb or the handle and a face of the second drawstring stop is located within a path of the drawstring when the drawstring is released from a drawn position.

In some embodiments, the first drawstring guide comprises a first roller and the second drawstring guide comprises a second roller.

In some embodiments, the first roller defines a portion of the first drawstring void and the second roller defines a portion of the second drawstring void.

In some embodiments, a longitudinal axis of the first limb and a longitudinal axis of the handle form an angle of between 90 degrees and 180 degrees; and wherein a longitudinal axis of the second limb and the longitudinal axis of the handle form an angle of between 270 degrees and 360 degrees.

In some embodiments, the first elastic portion and the second elastic portion comprise a material with a modulus of elasticity of at least 0.01 GPa and not more than 0.2 GPa.

In some embodiments, the drawstring has a length that is at least 1.5 times longer when the drawstring is in a drawn position compared to the length when the drawstring is in the non-drawn position.

In some embodiments, the first drawstring guide void and the second drawstring guide void are located at least 4 inches apart.

An embodiment described herein provides a sling bow, comprising a handle; a first limb comprising a distal end and a proximal end, wherein the proximal end is coupled to the handle; a second limb comprising a distal end and a proximal end, wherein the proximal end is coupled to the handle; a drawstring comprising a first elastic portion, a second elastic portion, and a non-elastic portion between the first and second elastic portions, wherein a first end of the first elastic portion is coupled to the distal end of the first limb and a first end of the second elastic portion is coupled to the distal end of the second limb; a first drawstring guide, wherein the first drawstring guide defines a first drawstring void, wherein the drawstring extends through the first drawstring void; and a second drawstring guide, wherein the second drawstring guide defines a second drawstring void, wherein the drawstring extends through the second drawstring void. In some embodiments, the drawstring contacts the first drawstring guide and the second drawstring guide when the drawstring is in a drawn position. In some embodiments, the first limb and the second limb are configured to elastically deform when the drawstring is brought into a drawn position. In some embodiments, the first drawstring guide and the second drawstring guide are located rearward from the handle.

In some embodiments, the sling bow further comprises a first drawstring stop and a second drawstring stop. In some embodiments, the first drawstring stop extends from the first limb or the handle and a face of the first drawstring stop is located within a path of the drawstring when the drawstring is released from a drawn position. In some embodiments, the second drawstring stop extends from the second limb or the handle and a face of the second drawstring stop is located within a path of the drawstring when the drawstring is released from a drawn position.

BRIEF DESCRIPTION OF THE FIGURES

The technology may be more completely understood in connection with the following drawings, in which.

Figure 1:
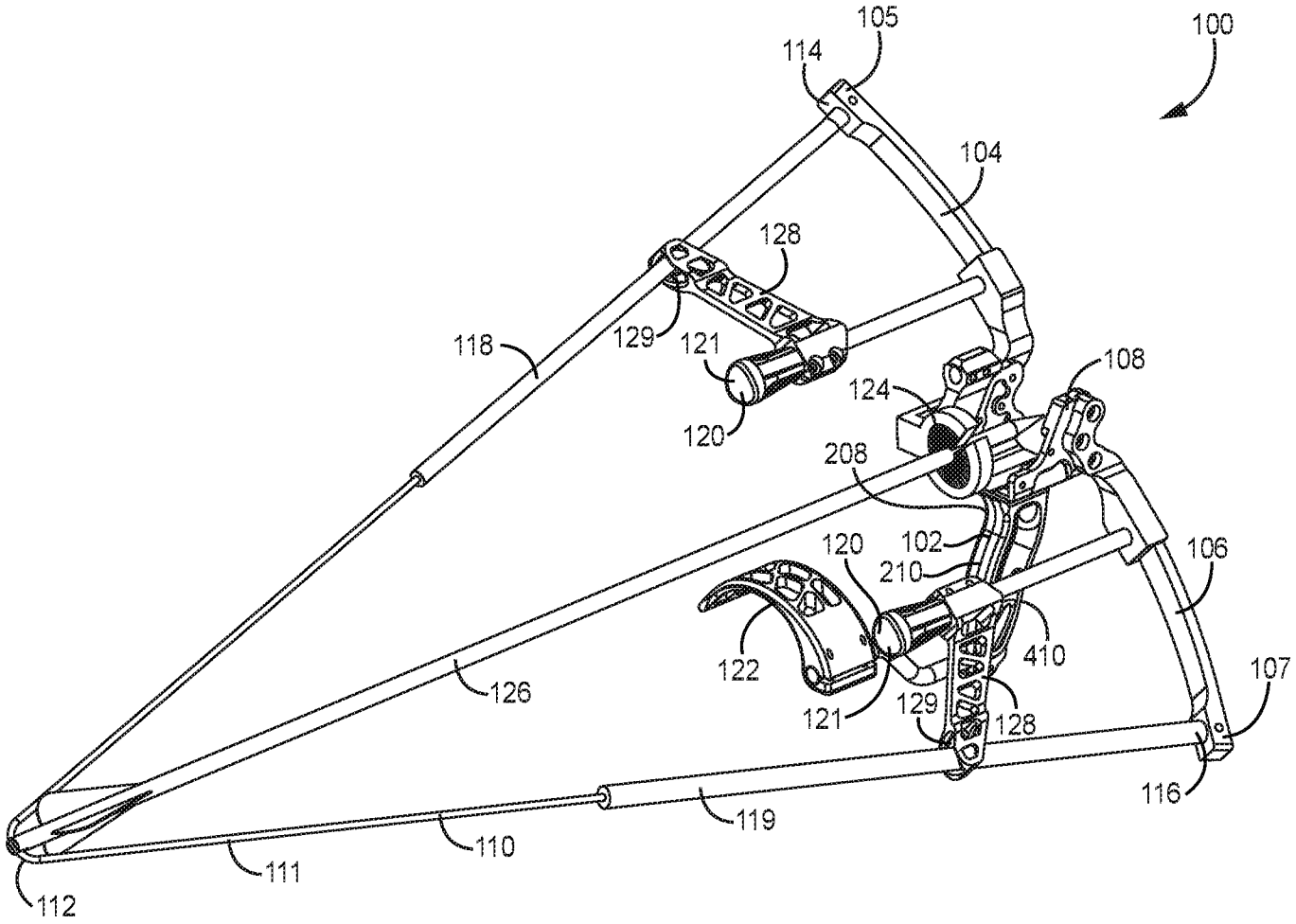
FIG. 1 is a perspective view of a sling bow with the drawstring in a drawn position, according to an embodiment.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

A sling bow is described herein. Generally, the sling bow can be used to shoot or propel a projectile or object, such as an arrow, a stone, or a ball, towards a target. A sling bow can be used for hunting, self-defense, or recreational target practice. A sling bow can store potential energy generated by a user drawing a drawstring or spring element away from a handle. The sling bow can store potential energy in the drawstring, in one or more limbs, or in both the drawstring and in the one or more limbs. The drawstring and the limbs can be elastically deformable, such that they can deform when the drawstring is drawn away from the handle. When a user releases the drawstring, or the drawstring and limbs, return to their non-deformed state and the potential energy is transferred to the object, propelling the object forward past the handle and towards the intended target.

The sling bow can include two limbs coupled to a handle. A drawstring can extend from one limb to the other, such as from the distal end of one limb to the distal limb of the other.

The drawstring can include an elastic portion, such that a portion of the drawstring can be stretched when a user draws or pulls the drawstring away from the handle in preparation for shooting a projectile from the sling bow. In some embodiments, the drawstring can also include an inelastic portion. In an embodiment, the drawstring includes an inelastic portion between two elastic portions. Each of the elastic portions can be coupled to one of the limbs.

The limbs can be flexible similar to the limbs of a bow for archery. The limbs can elastically deform when a projectile is shot from the sling bow. The limbs can store or provide additional force to propel the projectile in the desired direction, similar to the limbs of an archery bow. In various embodiments, the energy used to propel the projectile can be stored in the drawstring and in the limbs. In an embodiment, approximately half of the energy used to propel the projectile is transferred from the user to the projectile through the drawstring and the other half of the energy is transferred from the user to the projectile through the limbs.

In various embodiments, the sling bow can be configured to fit a right-handed user or a left-handed user. A right-handed user will grip the handle with his/her left hand and pull or draw the drawstring away from the handle with his/her right hand. Alternatively, a left-handed user will grip the handle with his/her right hand and pull or draw the drawstring away from the handle with his/her left hand.

The sling bow can include one or more drawstring stops. The drawstring stops can extend from the handle or the limbs towards the drawstring or in the opposite direction of the intended target. When the drawstring is released from the drawn position, the drawstring can travel towards the handle to propel the projectile in the intended direction. As the drawstring travels towards the handle, the drawstring can contact or be stopped by one or more drawstring stops. The drawstring stops can include a face or surface within the pathway of the drawstring when the drawstring is released from a drawn position. The drawstring stops can reduce the amount the drawstring bounces or flops around after it has been released from the drawn position. The reduction in bouncing and flopping can reduce the amount of noise created by shooting the sling bow. Further, the drawstring stops can provide some protection from the drawstring travelling forward and contacting the user's handle holding hand or arm.

The sling bow can include one or more drawstring guides. The drawstring guides can define a void in which a portion of the drawstring is disposed within. The drawstring guides can at least partially guide the drawstring, such as after the drawstring has been released from the drawn position. The drawstring guides can direct the drawstring, such that the drawstring contacts the drawstring stops after the drawstring is released from a drawn position.

Figure 2:
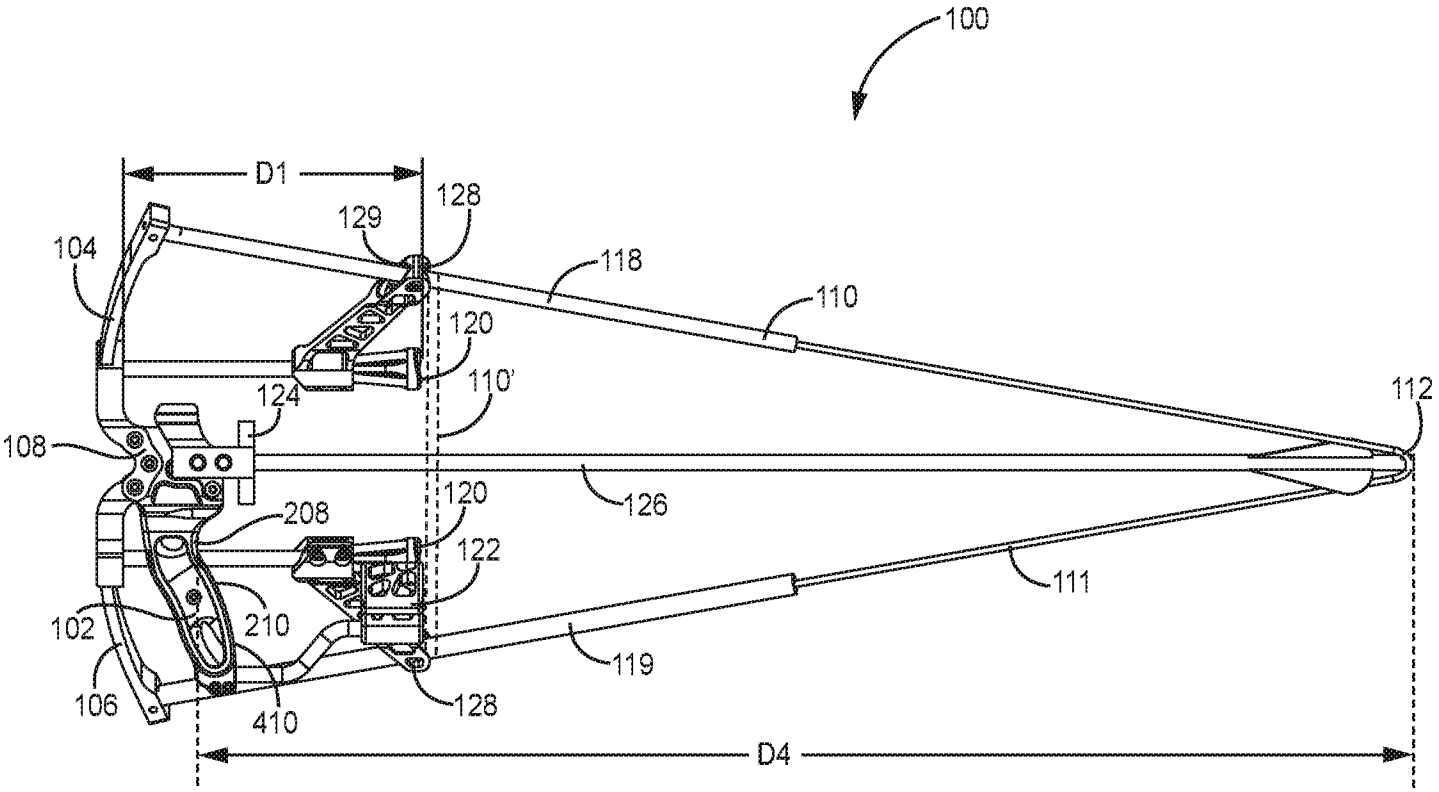
FIG. 2 is a side view of the sling bow shown in FIG. 1, according to an embodiment.
Figure 3:
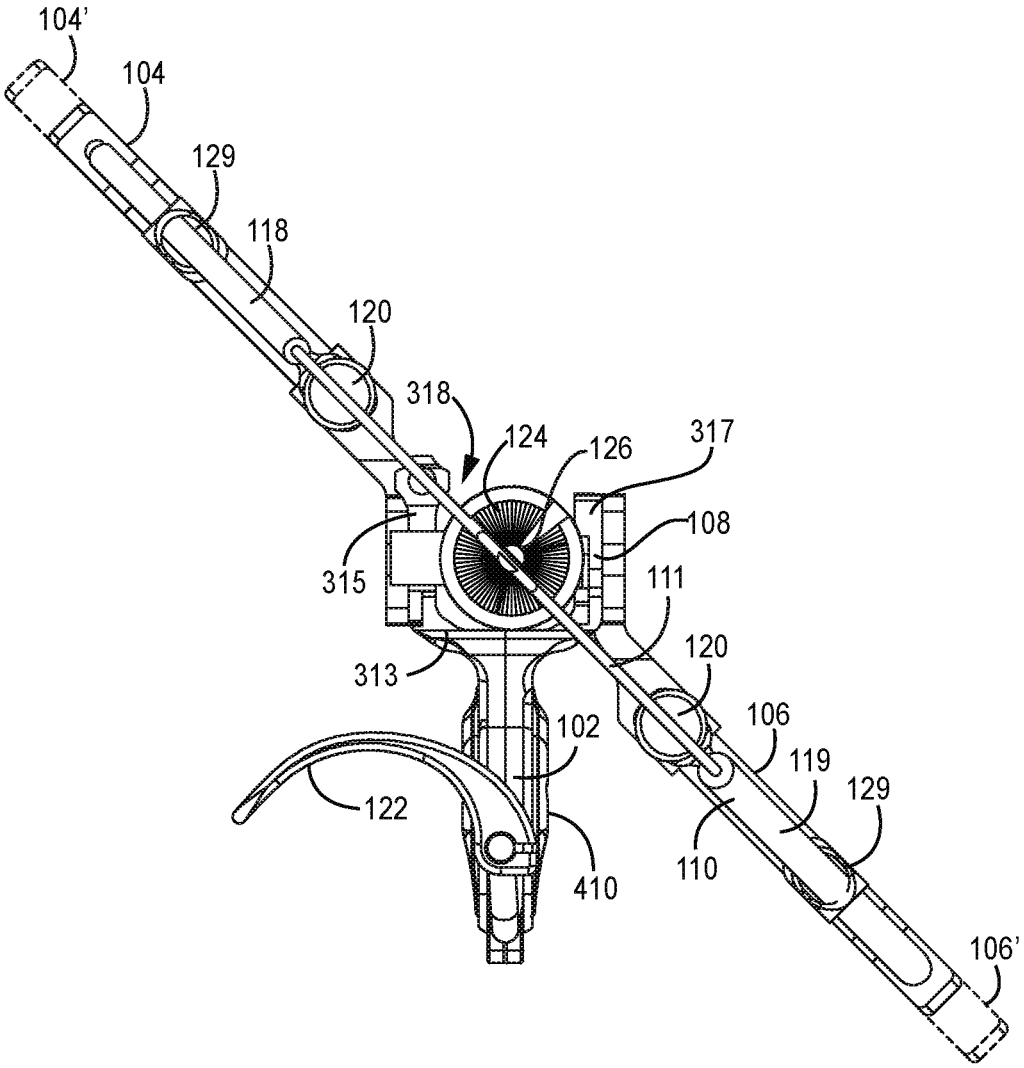
FIG. 3 is a rear view of the sling bow shown in FIG. 1, according to an embodiment.

In reference now to the figures, FIGS. 1-3 show views of a sling bow 100 in a drawn position. FIG. 1 is a perspective view of the sling bow 100. FIG. 2 is a side view of the sling bow 100. FIG. 3 is a rear view of the sling bow 100.

The sling bow 100 can include a handle 102, a first limb 104, a second limb 106, a drawstring 110, a drawstring guide 128, a drawstring stop 120, an arm support 122, and an arrow rest 124. FIGS. 1-3 show the sling bow 100 in a drawn position. In a drawn position, the drawstring 110 is pulled away from the handle 102, such that when the drawstring 110 is released, the projectile 126 will be propelled forward. In the embodiment shown in FIGS. 1-3, the projectile 126 is in the form of an arrow. In other embodiments, the projectile can be a rock, a ball, or other similar objects.

FIGS. 4-7 show the sling bow 100 in a non-drawn position, where the drawstring is resting on the drawstring stops, in perspective, side, front and rear positions, respectively. In FIGS. 4-7, the sling bow 100 is shown without an arrow rest and without an arrow or other projectile.

The handle 102 can include a grip portion 410 that is gripped or held by the user when the sling bow 100 is in use. The handle 102 can include a mounting portion 108. The mounting portion 108 can aid in coupling the limbs 104, 106 to the handle 102. In various embodiments, the handle 102 can include a top surface 313, and two projections 315, 317. The projections 315, 317 can extend from the top surface 313. In various embodiments, including the embodiment of FIGS. 4-7, the mounting portion 108 is on the opposite side of the top surface 313 from the grip portion 410. In some embodiments, the mounting portion 108 can define a plurality of holes or apertures 109, such as in one or both of the projections 315, 317, such that a limb can be coupled to the handle 102 with a connector, such as a bolt. In an embodiment, the projections 315, 317 can extend out from the grip portion 410 or the top surface 313, such as to create a "Y" shape or to define a channel 318. In various embodiments, the projections 315, 317 can extend to be perpendicular to the top surface 313. The projections 315, 317 can each have a longitudinal axis which is parallel to a longitudinal axis of the handle 102. In various embodiments, the projections 315, 317 are rigid, such that a user cannot observe the projections 315, 317 deflecting or deforming in standard use of the sling bow 100.

The mounting portion 108 can be configured to couple extra or supplementary components to the sling bow 100, in addition to providing a coupling point for the limbs 104, 106. The mounting portion 108 can be configured to couple a sight for aiding a user in more accurately aiming the sling bow 100 at an intended target. The mounting portion 108 can be configured to couple an arrow rest 124 to the handle, such as shown in FIG. 1. The mounting portion 108 can be configured to couple other accessories to the sling bow, such as a bow-fishing reel. In alternative embodiments, an arrow rest can be a portion of the handle 102.

In some embodiments, an arm support 122 can be coupled to the handle 102. The arm support 122 can extend away from the handle 102 and towards the drawstring 110. The arm support 122 can be configured to rest on the forearm of a user. The arm support 122 can rest on the user's forearm of the arm with which he or she is holding the handle 102. The arm support 122 can provide a force preventing the sling bow 100 from rotating upwards when the drawstring 110 is drawn away from the handle 102. The arm support 122 can include padding or webbing to increase a user's comfort.

The limbs 104, 106 can each include a first end or proximal end that is coupled to the handle 102, such as at the mounting portion 108. The second end or distal end of each limb 104, 106 can extend away from the handle 102. In various embodiments, the proximal end of each limb 104, 106 can be directly coupled to a portion of the handle 102, such as the mounting portion 108, and the distal end of each limb 104, 106 is coupled to an end of the drawstring 110, such as the distal end of the first limb 104 being coupled to a first elastic portion of the drawstring and the distal end of the second limb 106 being coupled to a second elastic portion of the drawstring.

Figure 8:
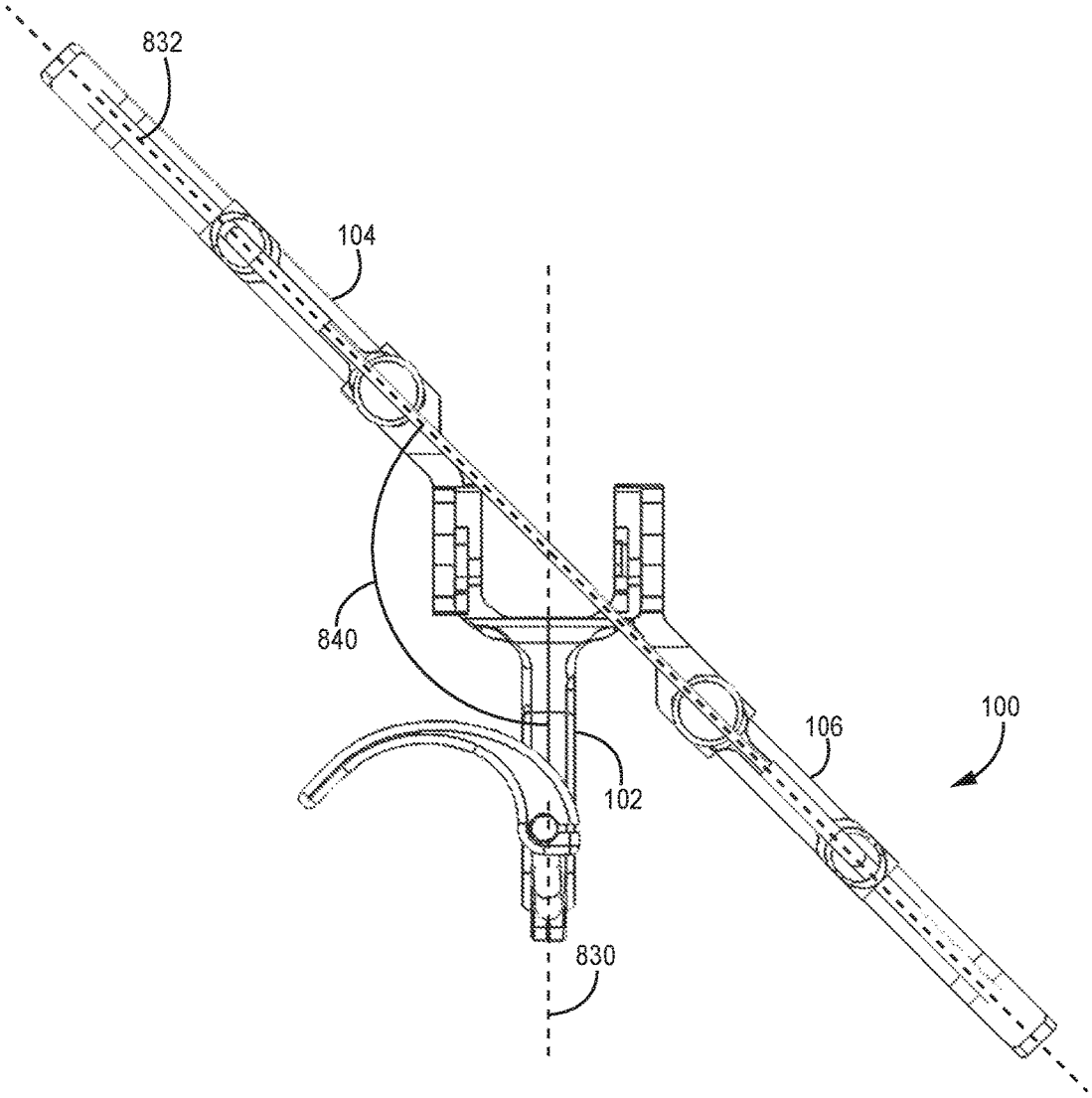
FIG. 8 is a rear view of a sling bow, according to an embodiment.
Figure 9:
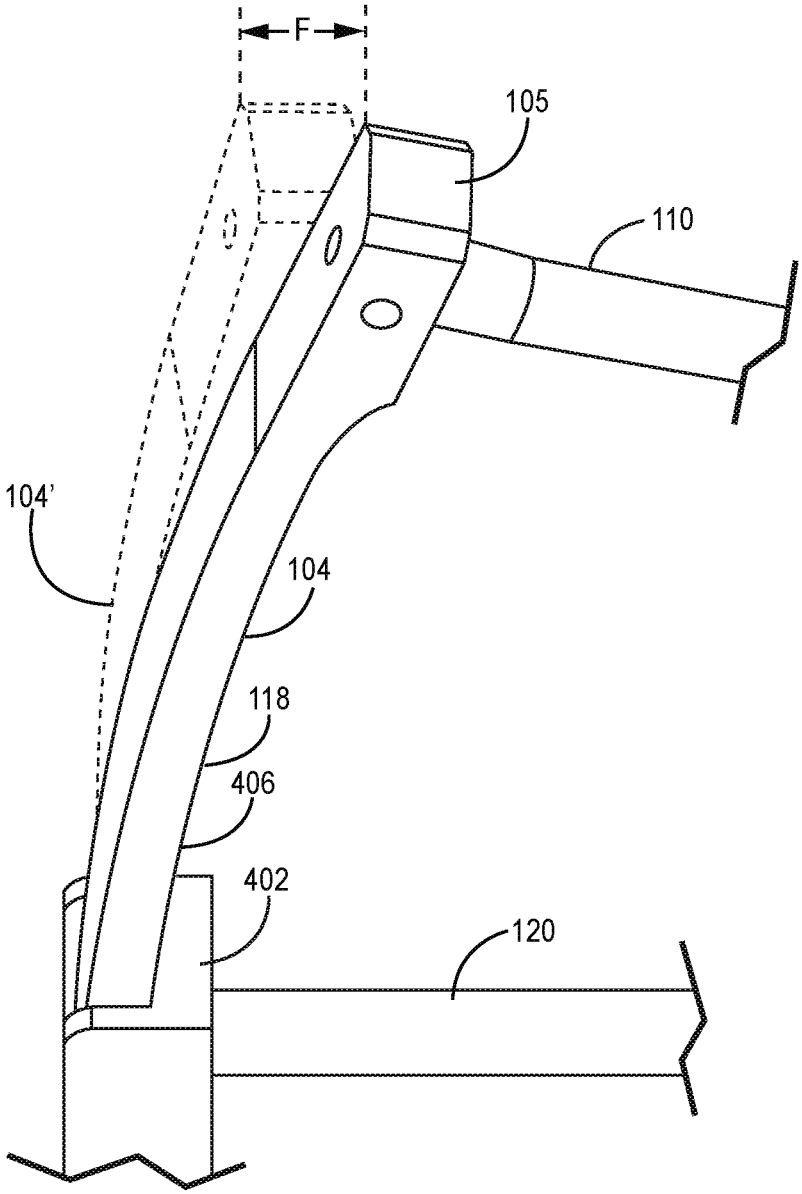
FIG. 9 is a side view of one limb of a sling bow, according to an embodiment.

In various embodiments, the limbs 104, 106 extend in opposite directions, such as 180 degrees away from each other (as shown in FIGS. 3, 8 and 9). The limbs 104, 106 can be coupled to the handle 102 at a wide range of different angles. As shown in FIG. 3, one limb extends from the handle 102 at approximately 45 degrees and the other limb extends from the handle 102 at approximately 225 degrees. In another embodiment, one limb extends from the handle 102 at approximately 0 degrees and the other limb extends from the handle 102 at approximately 180 degrees. In another embodiment, one limb extends from the handle 102 at approximately 90 degrees and the other limb extends from the handle 102 at approximately 270 degrees. Further description of the positioning of the limbs is provided in regards to FIGS. 8 and 9.

Drawstring

The drawstring 110 can extend from the distal end of one of the limbs 104, 106 to the distal end of the other limb 104, 106. In an embodiment, a first end of the drawstring 110 is coupled to the distal end 105 of the first limb 104 and the distal end 107 of the drawstring 110 is coupled to the second end of the second limb 106. The drawstring 110 can be flexible, stretchable or elastic, such that the force required to draw the drawstring 110 away from the handle 102 can be transferred to the projectile 126 when the drawstring 110 is released.

In various embodiments, the drawstring 110 can have a length that is about 1.5 times longer in the drawn position than in the at rest or non-drawn position. In various embodiments, the drawstring 110 can have a length that is about 2.0 times longer in the drawn position than in the at rest or non-drawn position. In various embodiments, the drawstring 110 can have a length that is about 2.5 times longer in the drawn position than in the at rest or non-drawn position. In various embodiments, the drawstring 110 can have a length that is at least about 1.5 times longer in the drawn position than in the at rest or non-drawn position. In various embodiments, the drawstring 110 can have a length that is at most about 3 times longer in the drawn position than in the at rest or non-drawn position.

In various embodiments, the drawstring 110 can include a first elastic portion 118, a second elastic portion 119 and an inelastic or non-elastic portion 111. In an embodiment, the drawstring 110 includes one inelastic portion 111 and two elastic portions 118, 119, such that the inelastic portion 111 can be located between the two elastic portions 118, 119. In an embodiment, one end of the inelastic portion 111 is couple to the first elastic portion 118 and the other end of the inelastic portion 111 is coupled to the second elastic portion 119. In an embodiment, one end of an elastic portion 118, 119 is coupled to the distal end of a limb and the other end of the elastic portion 118, 119 is coupled to an end of the inelastic portion 111.

In an embodiment, to couple the inelastic portion 111 with an elastic portion 118, 119, an end of the inelastic portion 111 can be inserted within the end of the elastic portion 118, 119, such as when the elastic portion is a hollow tube. The end of the inelastic portion 111 that is within the elastic portion 118, 119 can be knotted or otherwise expanded relative to the adjacent portion of the inelastic portion. The end of the elastic portion 118, 119 can be crimped, sealed, tied off, or otherwise compressed to retain the end of the inelastic portion 111 within.

The inelastic portion 111 can be non-stretchable in normal use of the sling bow 100, such that a user does not notice the inelastic portion 111 lengthening or stretching. The inelastic portion 111 can be a string, such as a single strand or a multiple strand string. The inelastic portion 111 can include a material that is used for normal bow strings, such as linen, polymer, polyethylene, polyester, liquid crystal polymers, or para-aramid synthetic fiber, such as KEVLAR™ fiber, available from DuPont. The inelastic portion 111 can also include metal, such as metal wire.

Figure 11:
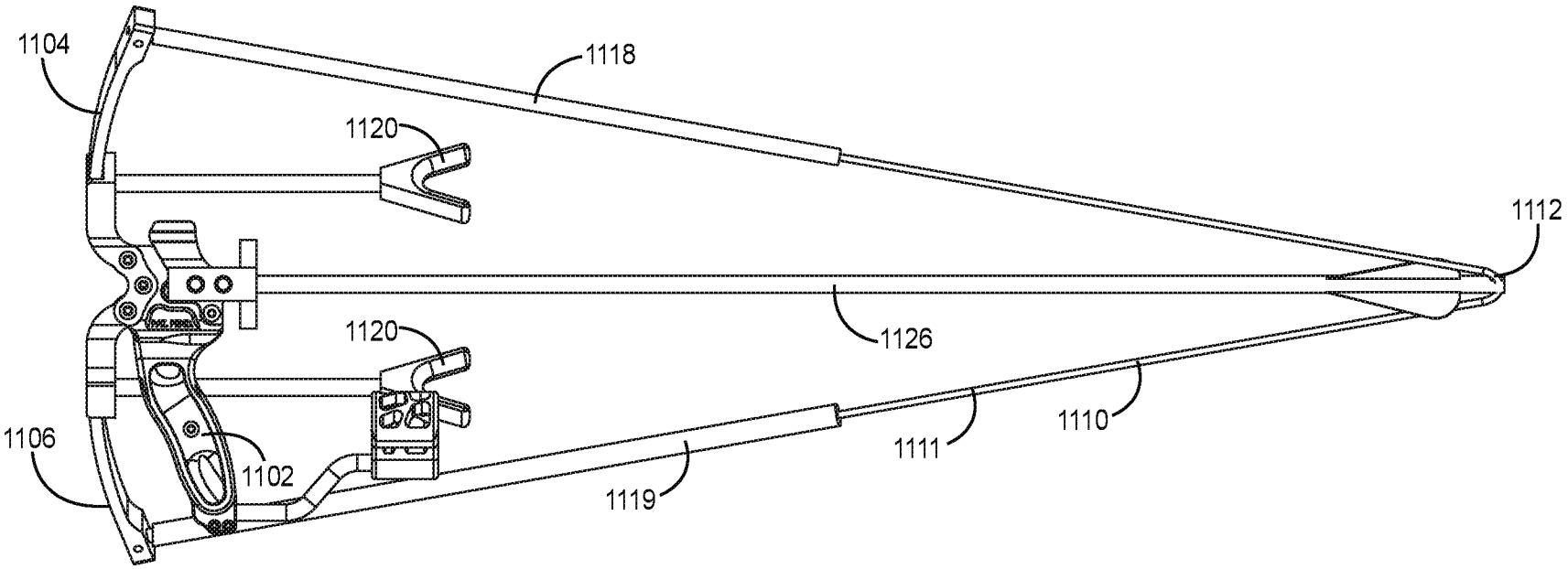
FIG. 11 is a side view of the sling bow shown in FIG. 10, according to an embodiment.
Figure 12:
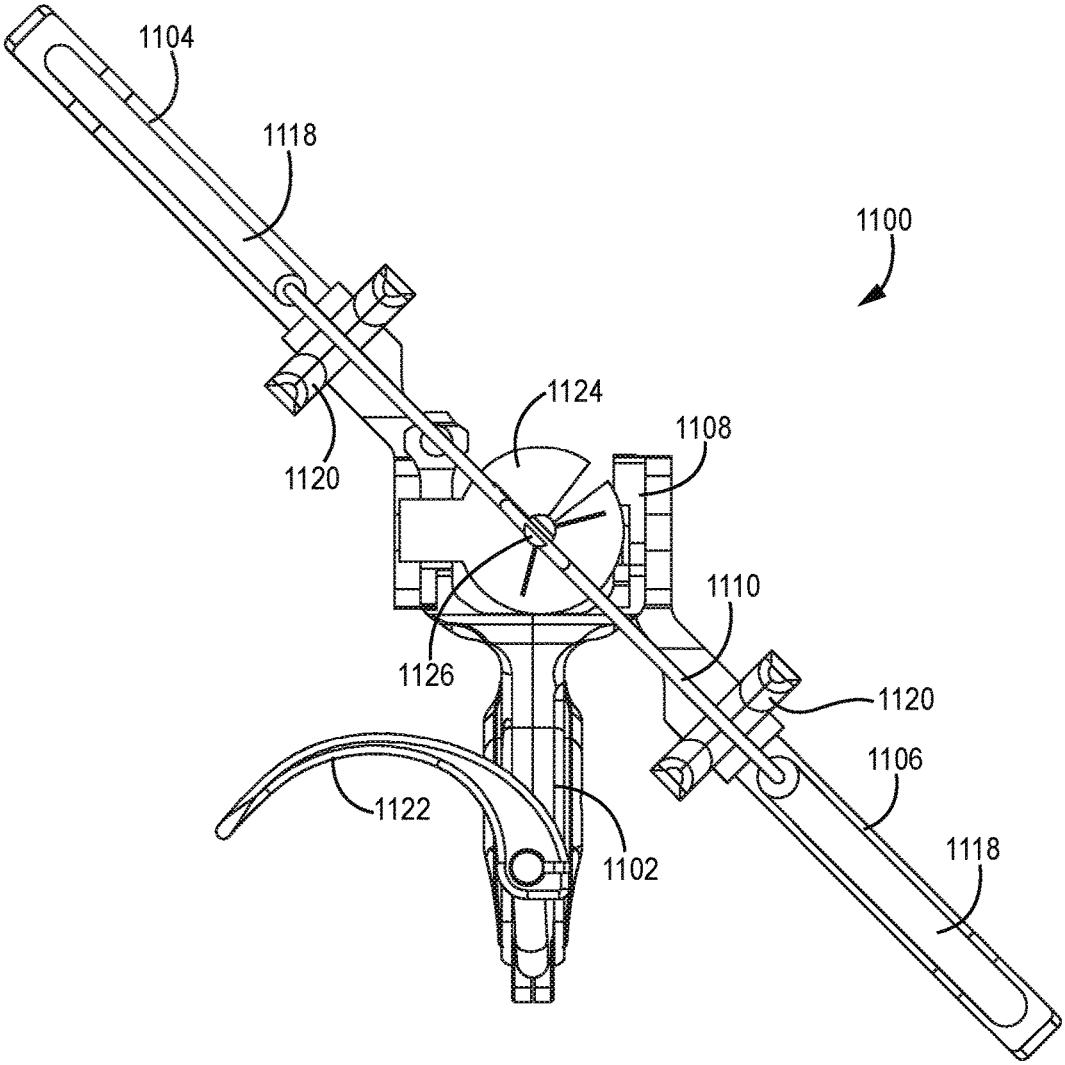
FIG. 12 is a rear view of the sling bow shown in FIG. 10, according to an embodiment.

The drawstring 110 can include a nocking point or nocking segment 112, which is a marked part of the drawstring for positioning the arrow nock. In alternative embodiments, the drawstring can include a pocket for holding a projectile, such as a rock or ball. In various embodiments, the inelastic portion 111 includes the nocking segment 112 or pocket. The nocking segment 112 is illustrated in FIGS. 2 and 11-12. In some embodiments, the drawstring 110 can include a D-loop for a release aid to be used with the sling bow 100. The D-loop can extend around the nocking segment 112.

In various embodiments, the inelastic portion 111 can include structure to define the nocking segment 112. Examples of such structures include knots and brass crimp-on beads. The nocking segment 112 can be located approximately in the middle of the inelastic section 111.

In an embodiment, the inelastic section 111 can be about 6 inches long. In an embodiment, the inelastic section 111 is at least 1 inch long and not more than 12 inches long.

In various embodiments, the elastic portions 118, 119 can include latex, rubber, vulcanized rubber, or a similar elastic material. In some embodiments, the elastic portions 118, 119 can include a material that has a modulus of elasticity of at least 0.01 GPa and not more than 0.2 GPa. In some embodiments, the elastic portions 118, 119 can include a material that has a modulus of elasticity of at least 0.01 GPa and not more than 0.3 GPa. In some embodiments, the elastic portions 118, 119 can include a material that has a modulus of elasticity of at least 0.01 GPa and not more than 0.5 GPa. In some embodiments, the elastic portions 118, 119 can include a material that has a modulus of elasticity of at least 0.01 GPa and not more than 1.0 GPa. In some embodiments, the elastic portions 118, 119 can include a material that has a modulus of elasticity of at least 0.01 GPa and not more than 2 GPa.

The elastic portion 118, 119 can be in the form of a tube with a hollow center, an extended cylinder-like shape, or a strip-like shape. In various embodiments, the elastic portions 118, 119 can be stretched such that it has a length of about 1.5 times, about 2 times, about 2.5 times, about 3 times, at least 1.25 times, or at most 3 times, when comparing the length at the drawn position to non-drawn position. In some embodiments, each section of the elastic portion 118, 119 can be about 10 inches long in a non-drawn position. In an embodiment, each section of the elastic portion 118, 119 can be at least 4 inches long and not more than 20 inches long in a non-drawn position. In various embodiments, the drawstring 110 can have a length of about 50 inches to 60 inches long when it is stretched into the drawn position.

Limbs

The limbs 104, 106 can be flexible, such that the limbs 104, 106 elastically deform when the drawstring 110 is drawn away from the handle 102, similar to the limbs of a standard archery bow that flex. In some embodiments, the limbs 104, 106 can be recurve limbs, such as described below in reference to FIGS. 13-15. In an embodiment, the limbs 104, 106 are partially flexible, where a portion of each limb is flexible and a portion of each limb is rigid. In various embodiment, the distal portion of the limbs 104, 106 is flexible and the proximal portion of the limbs 104, 106 is rigid. Now referring to FIG. 4, in various embodiments, the limbs 104, 106 each include a proximal rigid portion 402, 404 attached to the mounting portion 108 and a distal flexible portion 406, 408 attached to the rigid portion 402, 404, respectively. In some embodiments, the rigid portion 402, 404 can include metal such as aluminum, magnesium alloy or aircraft grade aluminum. In some embodiments, the flexible portion 406, 408 can include a composite material, such as a carbon fiber. In some embodiments, the limbs 104, 106 can include a polymer.

Figure 7:
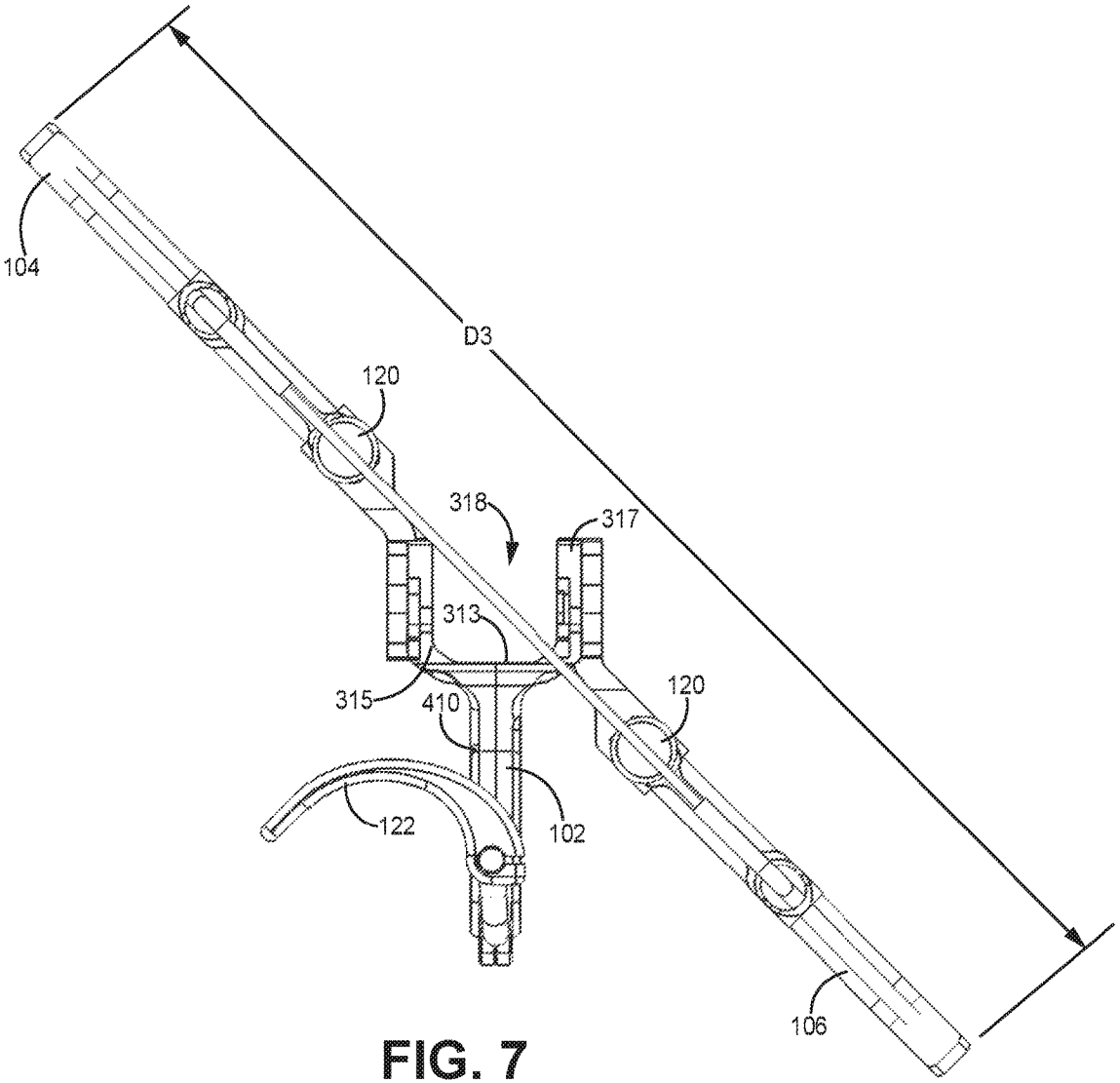
FIG. 7 is a rear view of the sling bow shown in FIG. 4, according to an embodiment.

Now referring to FIG. 7, in various embodiments, when in the non-drawn position, the distance D3 from the distal end of one limb to the distal end of the other limb can be about 17.5 inches. In an embodiment, the distance D3 from the distal end of one limb to the distal end of the other limb can be at least 4 inches and not more than 30 inches. In an embodiment, the distance from the distal end of one limb to the distal end of the other limb can be at least 15 inches and not more than 20 inches.

FIG. 9 is a close-up side view of a portion of the bow 100, showing first limb 104 in a drawn position and in dashed lines showing first limb 104' in an at-rest position. Flex distance F is the distance of travel experienced by a distal end of each of the limbs 104, 106 when moving from the non-drawn position to the drawn position. FIG. 9 shows the distal end 105 of limb 104 in a drawn position and in dashed lines shows distal end 105' of limb 104' in an at-rest position. FIG. 3 also illustrates the limbs 104, 106 in a drawn position and in dashed lines shows distal ends 105', 107' of limbs 104', 106' in an at-rest position. In various embodiment, the flex distance F is at least 0.25 inch, at least 0.5 inch, at least 0.75 inch, at least 1 inch, at most 0.75 inch, at most 1 inch, at most 1.5 inch, at most 2 inches, or about 0.75 inch.

Drawstring Stops

Now referring to FIGS. 1, 2, 4 and 5, the sling bow 100 can include one or more drawstring stops 120. The drawstring stops can be located between the nocking segment 112 of the drawstring and the handle 102 when the sling bow 100 is in the drawn position. In some embodiments, each drawstring stop 120 can include a face 121 that is directed away from the handle 102 and towards the drawstring 110. The face 121 can be located within the path of the drawstring 110 when the drawstring is released from a drawn position, such that the drawstring can contact the face 121 and be prevented from traveling further in that direction. In some embodiments, the face 121 can be circular or rectangular. In some embodiments, the face 121 can be planar or flat. In some embodiments, the face 121 is curved, angled, sloped or non-planar. In some embodiments, the face 121 can be gently curved to provide a shallow cradle for the drawstring, as in the embodiment shown in FIGS. 1-5.

Figure 10:
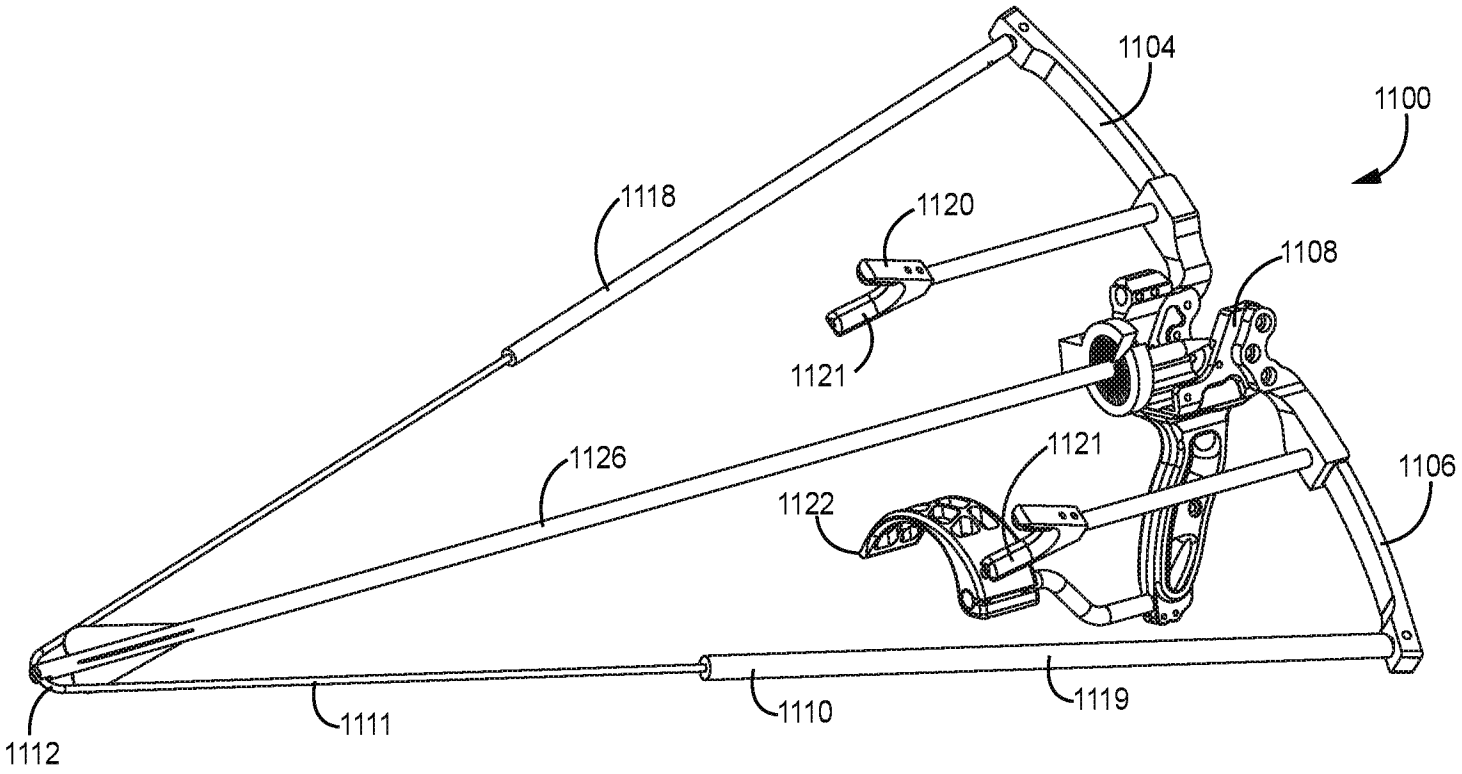
FIG. 10 is a perspective view of a sling bow, according to an embodiment.

In some embodiments, a face of drawstring stops can define a channel. FIGS. 10-12 show an alternate embodiment, where drawstring stops 1120 include a face 1121 which defines a channel with sloped sides.

The drawstring stops 120 can be coupled to the handle 102, the limbs 104, 106, or a rigid portion of the limbs 104, 106. In the embodiments of the drawings, each drawstring stop is coupled to a proximal, rigid portion of a limb. The drawstring stops 120 can extend rearward from the limbs 104, 104 and handle 102, such that drawstring stops 120 are located between the handle 102 and the user when shooting the sling bow 100. The drawstring stops 120 can be located inward from the distal ends 105, 107 of the limbs, such that when viewed from the rear (FIG. 3) the drawstring stops 120 are within an outer boundary defined by the distal ends 105, 107. In an embodiment, the drawstring stops 120 are located inward from the drawstring voids 129.

The drawstring stops 120 can absorb at least some of the remaining energy in the drawstring 110, such as to prevent or reduce the band 110 from bouncing around uncontrollably after the drawstring 110 is released. In an embodiment, the drawstring stop 120 can be a blunt surface or knob. The drawstring stop 120 can include rubber, polymer or metal. In some embodiments, the drawstring stop 120 can include a composite material.

In various embodiments, the distance between the face 121 of the drawstring stop 120 and the limbs (dimension D1 in FIG. 2) can be about 6 inches. In various embodiments, the distance D1 is at least 3 inches. In various embodiments, the distance D1 is 12 inches or less.

Drawstring Guides

The movement of the drawstring 110 can also be at least partially controlled by one or more drawstring guides 128. In an embodiment, the sling bow 100 can include two drawstring guides 128, such as one drawstring guide 128 to guide the drawstring 110 on one side of the projectile and one drawstring guide 128 to guide the drawstring 110 on the other side of the projectile. The drawstring guides 128 can be located rearward from the limbs 104, 104 and handle 102, such that drawstring guides 128 are located between the handle 102 and the user when shooting the sling bow 100. The drawstring guides 128 can be located inward from the distal ends 105, 107 of the limbs, such that when viewed from the rear (FIG. 3) the drawstring guides 128 are within an outer boundary defined by the distal ends 105, 107.

The drawstring guide 128 can define a void 129 that the drawstring 110 can extend through. In various embodiments that include two drawstring guides 128, the first drawstring void can be at least 3 inches away from the second drawstring void. In various embodiments, the first drawstring void can be at least 4 inches, at least 6 inches, at least 8 inches or at least 10 inches away from the second drawstring void. In some, the distance between the first and second drawstring void can be at most 18 inches, at most 16 inches, at most 14 inches, at most 13 inches or about 12 inches.

In various embodiments, the void 129 can be a closed aperture, such that a portion of the drawstring 110 is fully encapsulated or encircled within the drawstring guide 128. The drawstring guide 128 can be configured to stop or prevent the drawstring 110 from leaving the drawstring guide 128, such as by surrounding or encapsulating a portion of the drawstring 110 within the void 129.

Figure 16:
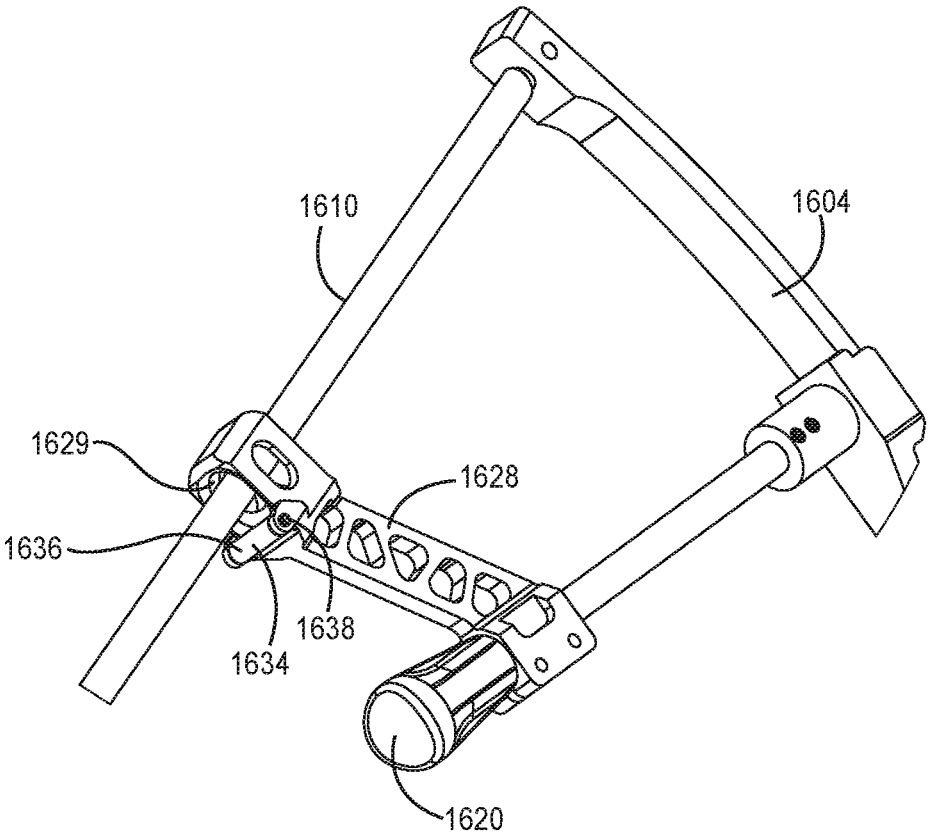
FIG. 16 is a perspective view of a portion of a sling bow with a roller, according to an embodiment.
Figure 17:
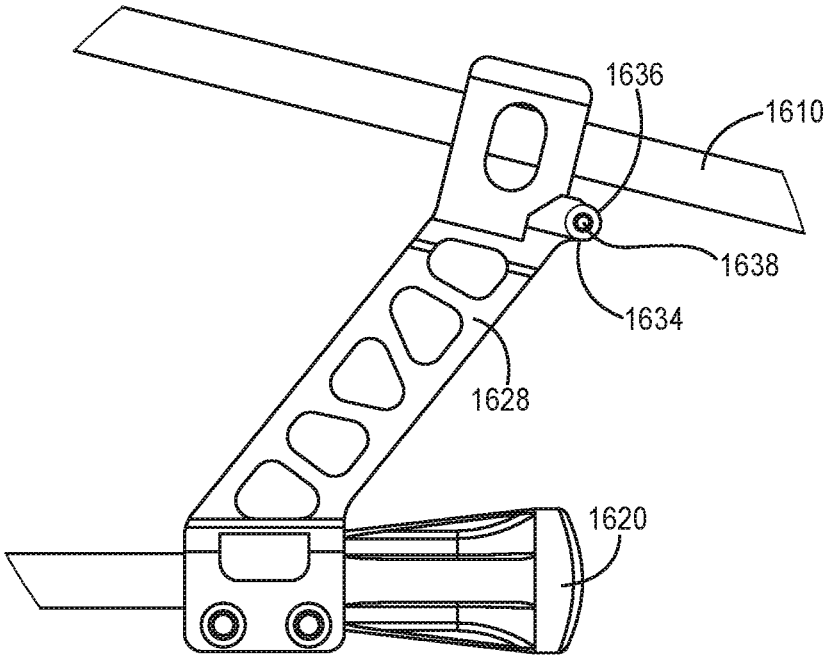
FIG. 17 is a side view of a portion of the sling bow with a roller shown in FIG. 16.

In an embodiment, the drawstring guide 128 can include a roller structure to define a portion of the void 129. In embodiments of the sling bow 100 that include two drawstring guides 128, each of the drawstring guides can include a roller. The roller structure can be configured such that the drawstring 110 slides along the roller. The roller can reduce resistance or friction between the drawstring 110 and the drawstring guide 128, such as when a user is drawing the drawstring away from the handle 102. A roller can include a rotating component that rotates around a fixed axle, so that the drawstring 110 causes rotation of the roller while being drawn. In some embodiments, the rotating component can be a cylinder. A sling bow embodiment with a roller is shown in FIGS. 16-17, and further described in relation to FIGS. 16-17

In an embodiment, the drawstring guides can include a void that defines an open channel, such as a "V" or "U" shaped catch, such that the void does not entirely encircle a portion of the drawstring. The open channel can include a notch or open area to catch, hold, or guide the drawstring. The drawstring can rest in the open area of the open channel. The sides of the open channel can direct the drawstring to the middle of the catch.

In some embodiments, the drawstring guide 128 can be coupled to a portion of one of the drawstring stops 120, one of the limbs 104, 106, or the handle 102. The drawstring guide 128 can prevent the portions of the drawstring 110 near the limbs 104, 106 from drooping or sagging. The drawstring guide 128 can aid in keeping a desired arrangement of the drawstring 110 with respect to the handle 102 and/or the limbs 104, 106. The drawstring guide 128 can direct or align the band 110 as it travels towards the handle 102 to contact the drawstring stops 120.

Limb and Brace Height Dimensions

Figure 4:
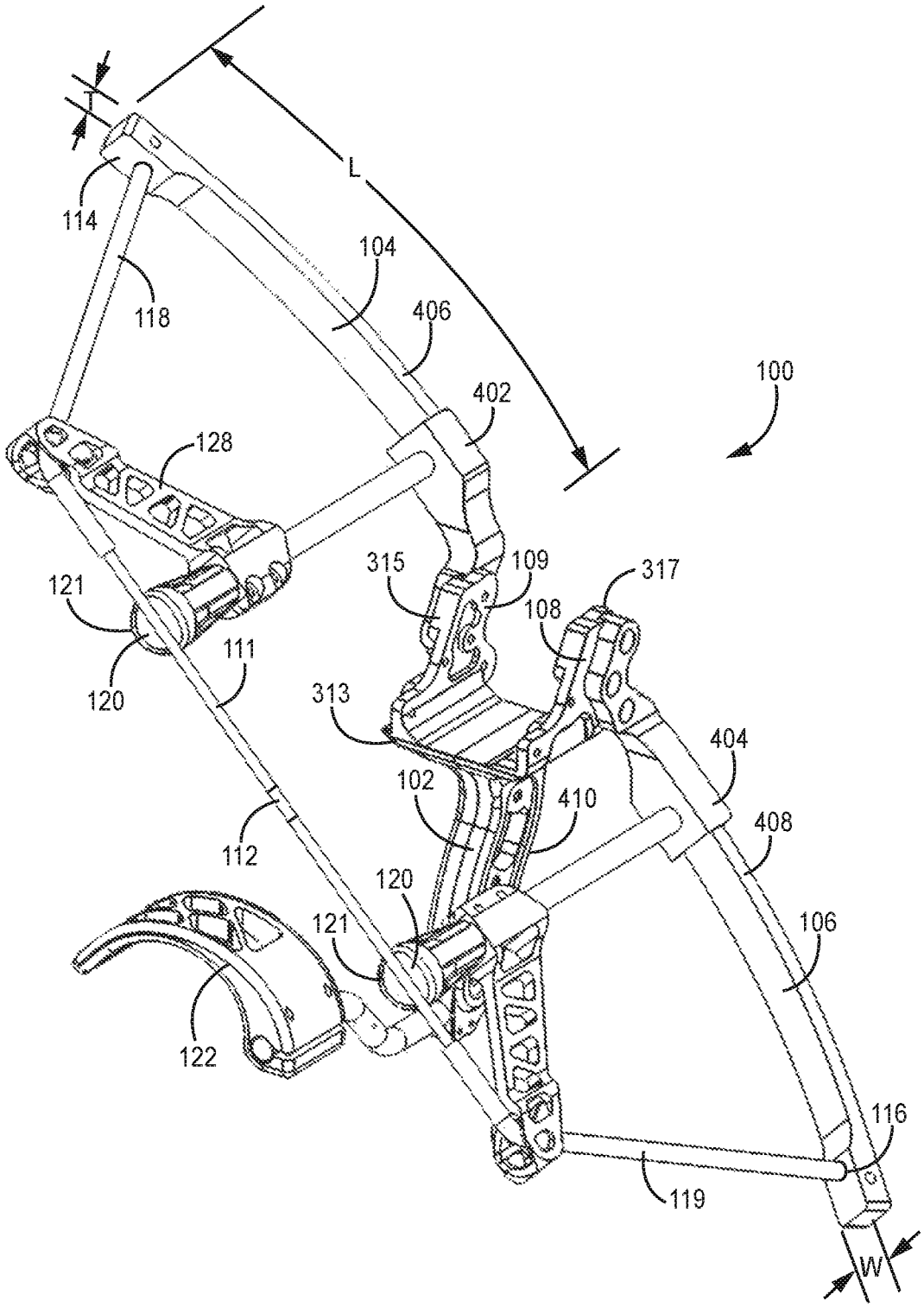
FIG. 4 is a perspective view of a sling bow with the drawstring in a non-drawn position, according to an embodiment.
Figure 5:
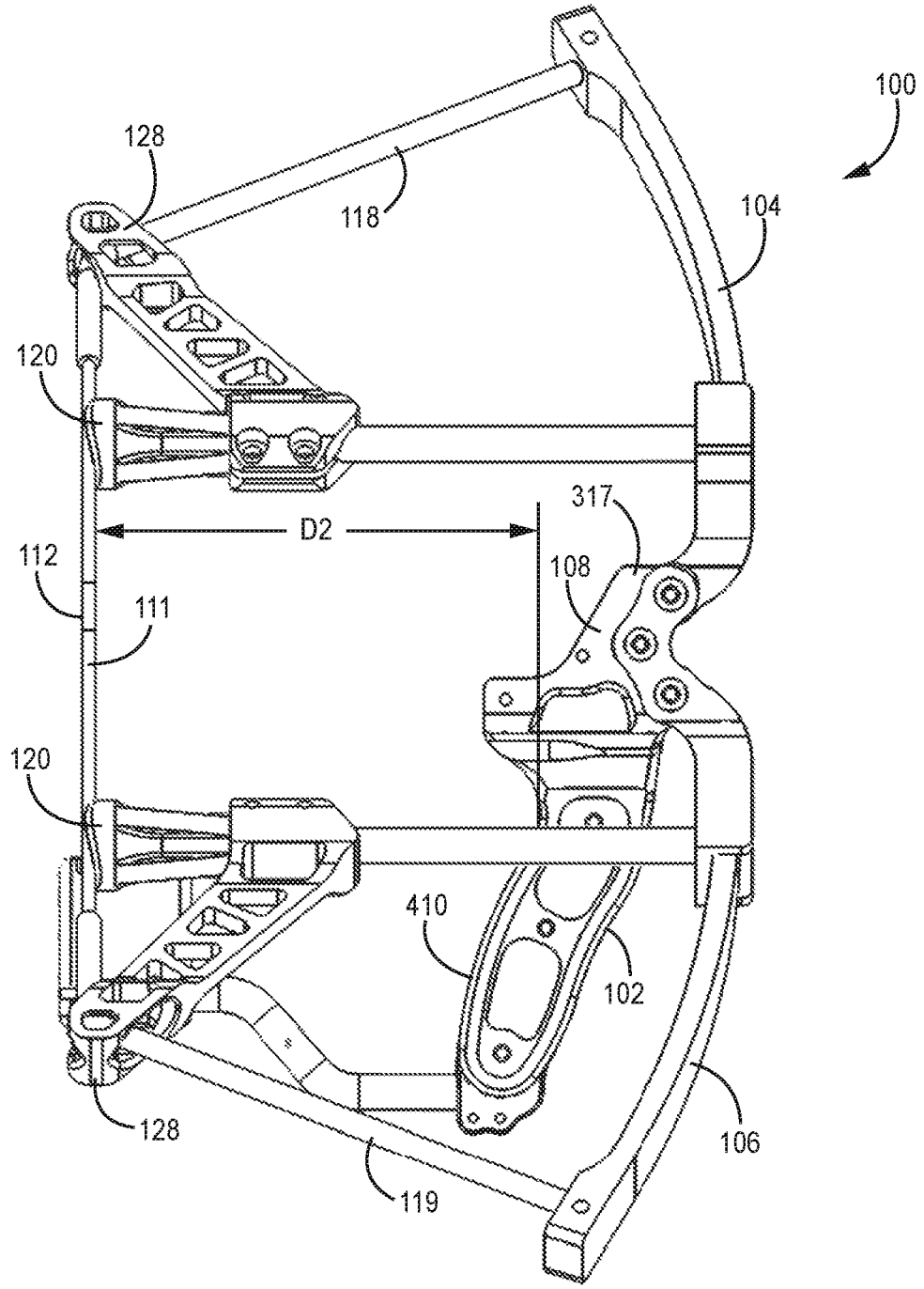
FIG. 5 is a side view of the sling bow shown in FIG. 4, according to an embodiment.
Figure 6:
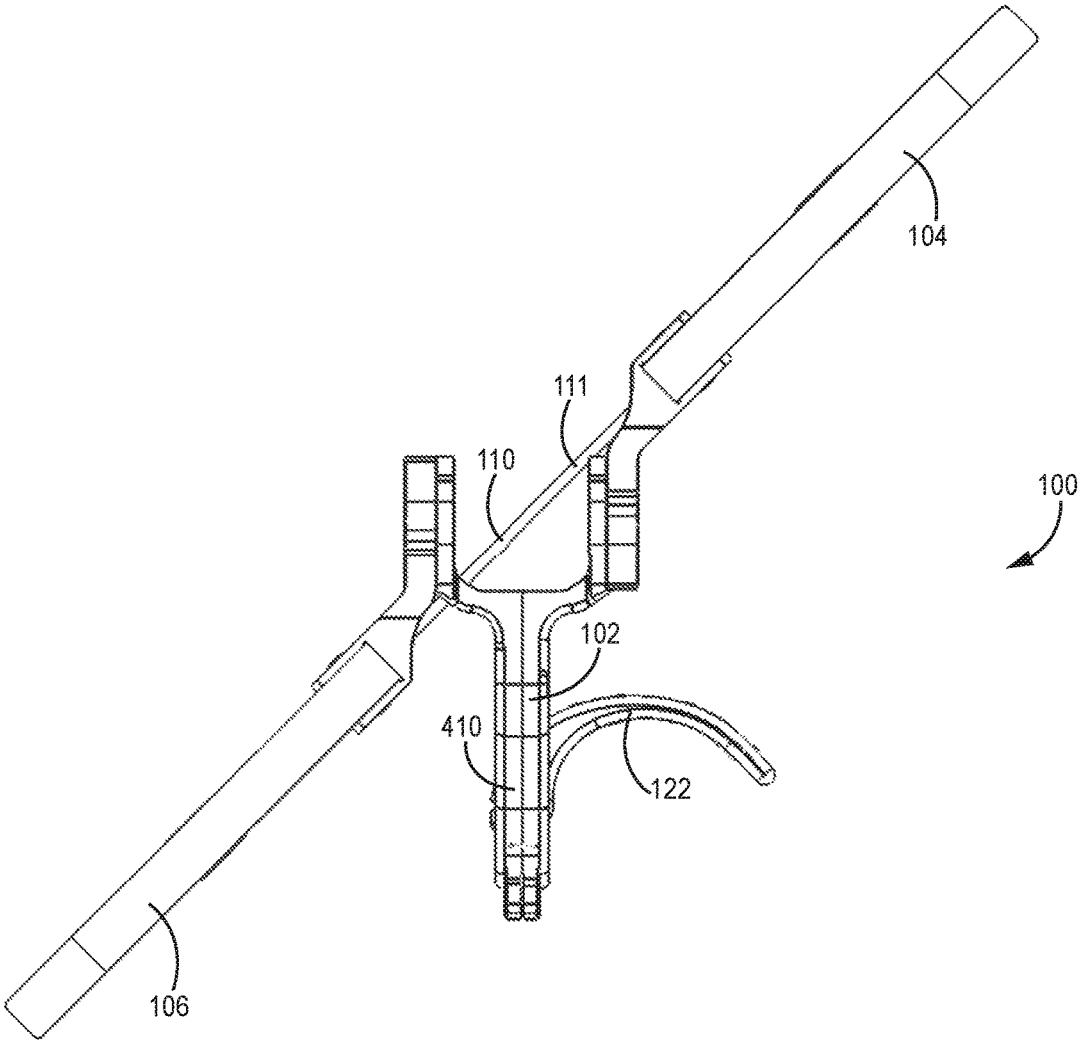
FIG. 6 is a front view of the sling bow shown in FIG. 4, according to an embodiment.

In reference now to FIG. 4-7, the sling bow 100 is shown in a non-drawn position. FIG. 4 shows a perspective view of the sling bow 100. FIG. 5 shows a side view of the sling bow 100. FIG. 6 shows a front view of the sling bow 100. FIG. 7 shows a back view of the sling bow 100.

FIG. 4 shows a perspective view of the sling bow 100. As discussed above, the sling bow 100 can include a first limb 104 and a second limb 106. The limbs 104, 106 can have a length L that extends from a proximal end of the limb that is coupled to the handle 102 to the distal end of the limb that is coupled to the drawstring. The limbs 104, 106 can have a thickness T that extends from a forward facing portion to a backwards facing portion, such as a dimension generally in the direction of travel for a projectile being shot from the sling bow 100. The limbs 104, 106 can have a width W that extends from a side portion to an opposite side portion, such as a direction generally perpendicular to the direction of travel for a projectile being shot from the sling bow 100. In various embodiments, the length of a limb is greater than the width or the thickness. In some embodiments, the length is at least 5 times greater than the width and/or the thickness of the limb. In some embodiments, the length is at least 10 times greater than the width and/or the thickness of the limb. In some embodiments, the width is greater than the thickness of the limb. In some embodiments, the width is at least 2 times greater than the thickness of the limb.

In some embodiments, the limbs 104, 106 can have a rectangular cross section. In some embodiments, the limbs 104, 106 can have a cross-section that has a constant shape along at least 50% of the limb's length. In some embodiments, the limbs 104, 106 can have a cross-section that has a constant size and shape along at least 50% of the limb's length.

As shown in FIG. 5, when the drawstring 110 is in a non-drawn or at rest position, the drawstring 110 can be supported by the drawstring guides 128 to define a brace height (dimension D2 in FIG. 5). The brace height can be the distance between the drawstring 110 and the deepest portion of the handle 102. In various embodiments, the brace height can be at least 2 inches and not more than 12 inches. In various embodiments, the brace height can be at least 3 inches and not more than 10 inches. In various embodiments, the brace height can be at least 4 inches, at least 5 inches, at most 7 inches, at most 8 inches or about 6 inches.

Limb Orientation

FIG. 8 shows a rear view of a sling bow 100. The handle 102 defines a handle axis 830 extending along a length of the handle 102 when viewed from the rear perspective of FIG. 8. The first limb 104 is separated by 180 degrees from the second limb 106, and the limbs define a limb axis 832 extending along the lengths of the limbs when viewed from the rear perspective of FIG. 8. Handle-limb angle 840 is the angle between the handle axis, measured starting at the handle and going in a clockwise direction to the first limb 104. In various embodiments, handle-limb angle 840 is about 135 degrees, at least 120 degrees, or at most 150 degrees. For left-handed sling bow with a mirrored configuration compared to the embodiments of the FIGS., the handle-limb angle 840 is about 45 degrees, at least 30 degrees, or at most 60 degrees.

In various embodiments, the handle-limb angle 840 can be at least 90 degrees and not more than 180 degrees for a right-handed sling bow. In various embodiments, the handle-limb angle 840 can be 0 to 90 degrees for a left-handed sling bow.

The FIGS. show embodiments where the limb axis is not parallel or aligned with the handle axis, and where the limb axis is not perpendicular to the handle axis.

As mentioned, it is possible for the sling bow 100 to be set up in a mirrored configuration from what is shown in the FIGS., such as for a left-handed user. For a left-handed user, the arm support 122 can extend to the right instead of to the left in the rear view of FIG. 8.

Draw Lengths

FIG. 2 shows the sling bow 100 with the drawstring 110 in the drawn position, as well as the at-rest drawstring 110' in dashed lines. Dimension D4 can be representative of a draw length of the sling bow 100. In various embodiments, the draw length of the sling bow 100 can be at least 12 inches, at least 20 inches, at least 25 inches, at most 35 inches, at most 40 inches, and about 30 inches. In various embodiments, the draw length of the sling bow can range from 12 inches to 35 inches. The elastic portions of the drawstring can be extended to a range of different lengths depending on the force put upon them, leading to a range in draw length for a given sling bow. Many archers have a draw length that falls in the range of 25 inches to 30 inches. The draw length can be measured from a deepest part 208 of the handle 102 to where the projectile 126 contacts the drawstring 110, such as at a nocking segment 112. The deepest part 208 of the handle 102 is the part of a face 210 of the grip portion 410 of the handle 102 that is farthest from the user.

Drawstring Stops

FIGS. 10-12 show a different configuration of a sling bow 1100, according to an embodiment, from a perspective view, side view and rear view, respectively. The configuration of the sling bow 1100 shown in FIGS. 10-12 does not include the drawstring guides 128.

The sling bow 1100 includes two drawstring stops 1120 with face 1121. The drawstring stops 1120 are "V" shaped, such that they define an open area to catch a drawstring 1110 as it travels in the direction of the handle 1102. The drawstring stops 1120 can define an inner open area or slot that the drawstring 1110 can travel into or contact. The drawstring stops 1120 can reduce the amount of energy in the drawstring 110, such as to reduce noise and/or prevent the drawstring 1110 from bouncing around once it is released from the drawn position.

Recurve Limbs

Figure 13:
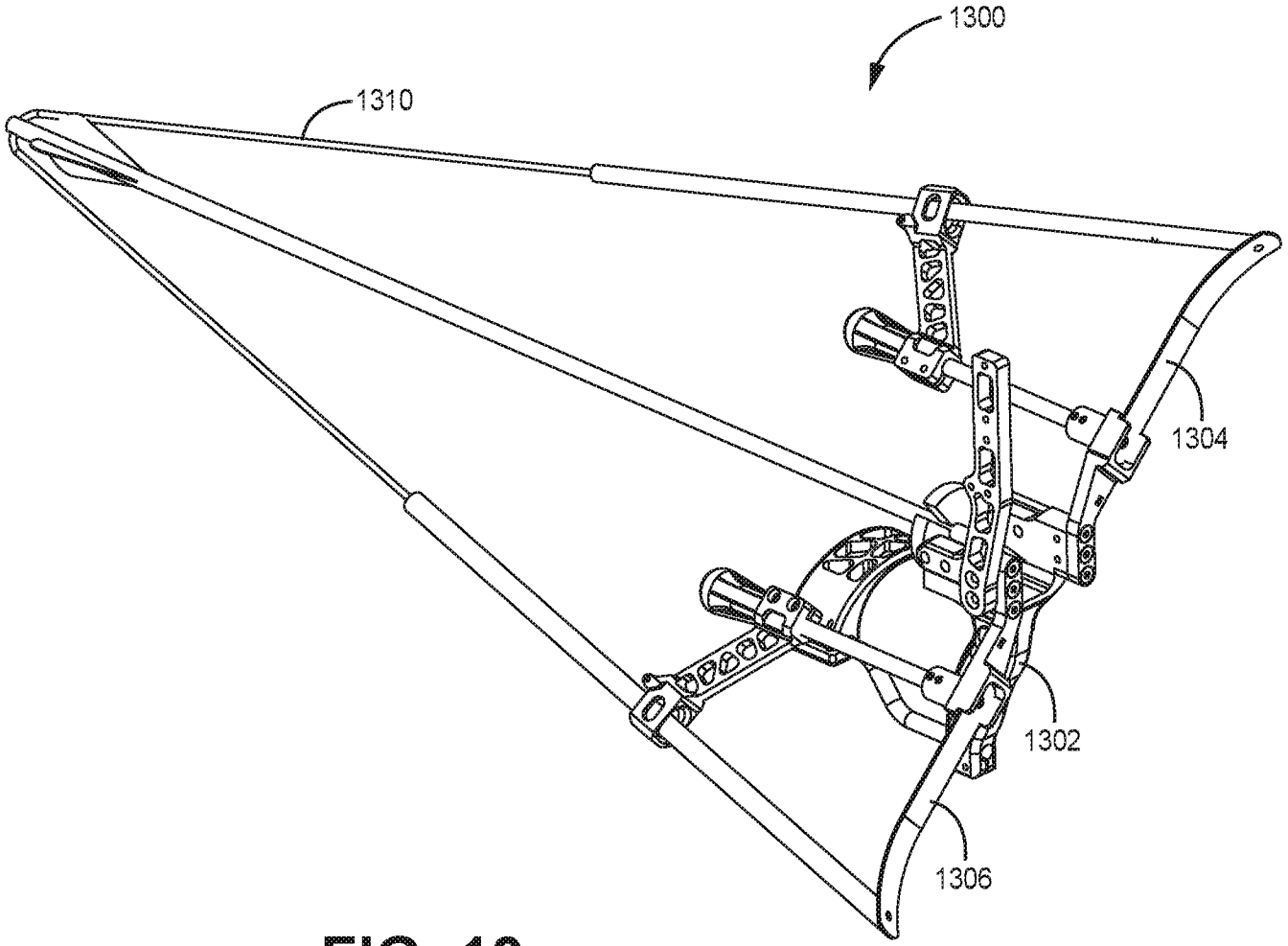
FIG. 13 is a perspective view of a sling bow with recurve limbs, shown with the drawstring in a drawn position, according to an embodiment.
Figure 14:
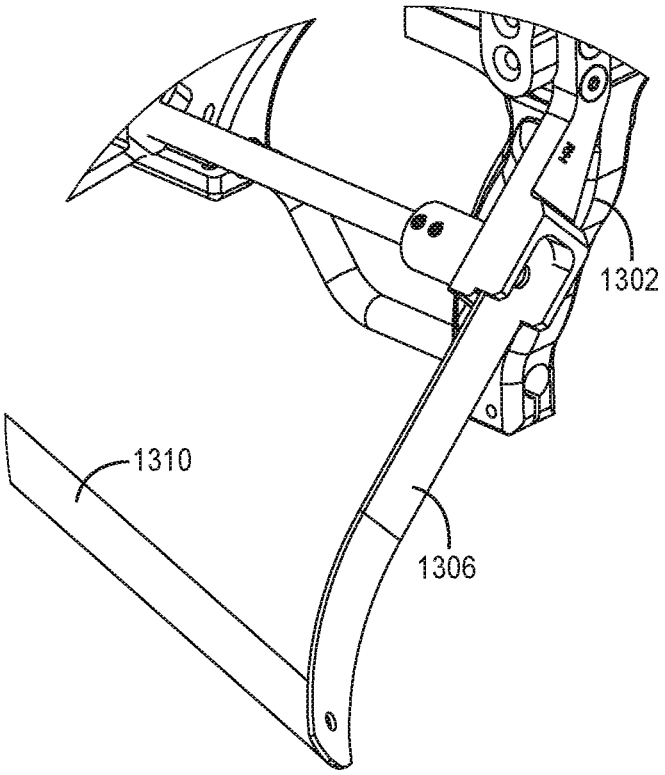
FIG. 14 is an enlarged portion of the perspective view of the sling bow shown in FIG. 13, showing the lower limb.
Figure 15:
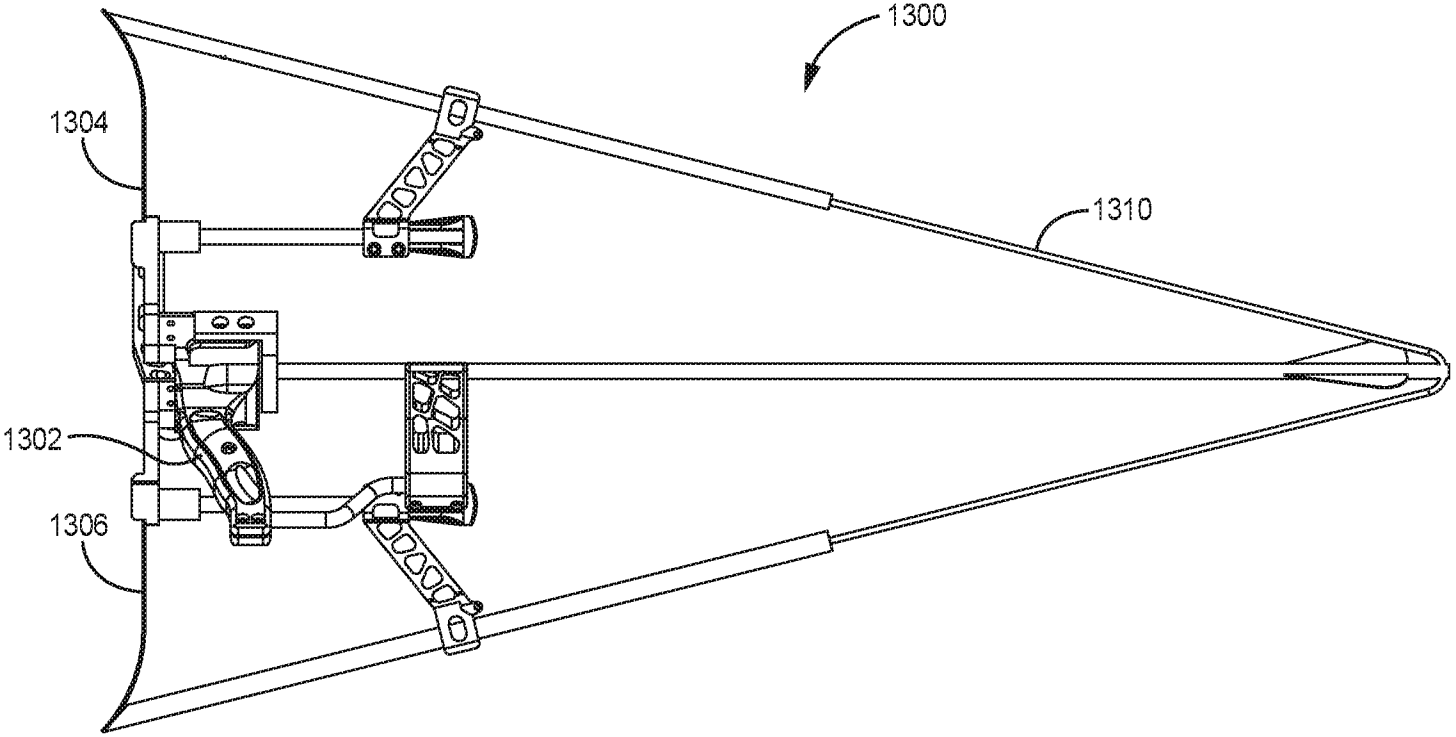
FIG. 15 is a side view of the sling bow with the drawstring in a drawn position shown in FIG. 13.

FIG. 13 shows a perspective view of a sling bow 1300 having recurve limbs, shown with the drawstring 1310 in a drawn position, according to an embodiment. FIG. 14 shows an enlarged portion of FIG. 13. FIG. 15 shows a side view of the sling bow 1300.

The sling bow 1300 can include a handle 1302, a first limb 1304, a second limb 1306 and a drawstring 1310. The drawstring 1310 can extend from the distal end of the first limb 1304 to the distal end of the second limb 1306. As mentioned above, in some embodiments, the first limb 1304 and second limb 1306 can be configured as recurve limbs.

Recurve limbs can include a curved portion of the tip of the limb. The curved portion of the limb can be curved away from the user, such that the tip of the limb is further way from the user than a portion of the limb that is adjacent to the tip. The curved portion of the limb 1304, 1306 can be concave away from the user as shown in FIGS. 13-15.

Roller

FIG. 16 shows a perspective view of a portion of a sling bow with a roller 1634, according to an embodiment. FIG. 17 shows a side view of a portion of a sling bow with a roller 1634. The sling bow shown in in FIG. 16 can include a limb 1604, a drawstring 1610, a drawstring stop 1620, and a drawstring guide 1628. The drawstring guide 1628 can define a drawstring void 1629. In various embodiments, the drawstring guide 1628 can include a roller 1634. The roller 1634 can include a rotating portion 1636 that can rotate around a fixed axle 1638.

In some embodiments, the roller 1634 can define a portion of the drawstring void 1629. In some embodiments, the drawstring 1610 can contact the roller 1634 when the drawstring is at rest in a non-drawn position. When the user draws or pulls the drawstring 1610, a portion of the drawstring 1610 can travel along and past the roller 1634, such as to reduce friction when compared to travelling along and past a non-rotating component. FIGS. 16 and 17 show only a portion of the sling bow having the roller 1634 as a part of the drawstring guide 1628. The sling bow of FIGS. 16 and 17 includes a second limb, drawstring stop, drawstring guide, and roller that are not shown.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

All publications and patent applications in this specification are indicative of the level of ordinary skill in the art to which this technology pertains. All publications and patent applications are herein incorporated by reference to the same extent as if each individual publication or patent application was specifically and individually indicated by reference.

The technology has been described with reference to various specific and preferred embodiments and techniques. However, it should be understood that many variations and modifications may be made while remaining within the spirit and scope of the technology.

The invention claimed is:

1. A sling bow designed to shoot a projectile, comprising:

a handle;

a first limb comprising a distal end and a proximal end, wherein the proximal end is coupled to the handle;

a second limb comprising a distal end and a proximal end, wherein the proximal end is coupled to the handle;

a drawstring comprising a first elastic portion, a second elastic portion, and a non-elastic portion between the first and second elastic portions, wherein a first end of the first elastic portion is coupled to the distal end of the first limb and a first end of the second elastic portion is coupled to the distal end of the second limb;

a first drawstring guide, wherein the first drawstring guide defines a first drawstring void, wherein the drawstring extends through the first drawstring void; and a second drawstring guide, wherein the second drawstring guide defines a second drawstring void, wherein the drawstring extends through the second drawstring void;

wherein when the drawstring is in a non-drawn position, the drawstring is supported by the first drawstring guide and the second drawstring guide to define a brace height between the drawstring and the handle;

wherein the first limb and the second limb are configured to elastically deform when the drawstring is brought into a drawn position.

2. The sling bow of claim 1, further comprising a first drawstring stop and a second drawstring stop;

wherein the first drawstring stop extends from the first limb or the handle and a face of the first drawstring stop is located within a path of the drawstring when the drawstring is released from a drawn position;

wherein the second drawstring stop extends from the second limb or the handle and a face of the second drawstring stop is located within a path of the drawstring when the drawstring is released from a drawn position.

3. The sling bow of claim 1, wherein the first drawstring guide comprises a first roller and the second drawstring guide comprises a second roller.

4. The sling bow of claim 3, wherein the first roller defines a portion of the first drawstring void and the second roller defines a portion of the second drawstring void.

5. The sling bow of claim 1, wherein the first elastic portion and the second elastic portion comprise a material with a modulus of elasticity of at least 0.01 GPa and not more than 0.2 GPa.

6. The sling bow of claim 1, wherein the drawstring has a length that is at least 1.5 times longer when the drawstring is in a drawn position compared to the length when the drawstring is in the non-drawn position.

7. The sling bow of claim 1, wherein a limb longitudinal axis and a handle longitudinal axis form an angle of between 120 degrees and 150 degrees in a right-handed configuration of the sling bow.

8. The sling bow of claim 1, wherein the first limb and the second limb comprise carbon fiber.

9. The sling bow of claim 1, wherein the first drawstring guide is coupled to the handle or the first limb and the second drawstring guide is coupled to the handle or the second limb.

10. The sling bow of claim 1, wherein the first drawstring void and second drawstring void are each one of the group consisting of an open channel or a closed aperture.

11. A sling bow designed to shoot a projectile, comprising:

a handle;

a first limb comprising a distal end and a proximal end, wherein the proximal end is coupled to the handle;

a second limb comprising a distal end and a proximal end, wherein the proximal end is coupled to the handle;

a drawstring comprising a first elastic portion, a second elastic portion, and a non-elastic portion between the first and second elastic portions, wherein a first end of the first elastic portion is coupled to the distal end of the first limb and a first end of the second elastic portion is coupled to the distal end of the second limb;

a first drawstring guide, wherein the first drawstring guide defines a first drawstring void, wherein the drawstring extends through the first drawstring void; and a second drawstring guide, wherein the second drawstring guide defines a second drawstring void, wherein the drawstring extends through the second drawstring void;

wherein when the drawstring is in a non-drawn position, the drawstring is supported by the first drawstring guide and the second drawstring guide to define a brace height between the drawstring and the handle;

wherein the first limb and the second limb each have a length, a width, and a thickness, and the length of the first limb is greater than the first limb's width and thickness, and the length of the second limb is greater than the second limb's width and thickness.

12. The sling bow of claim 11, further comprising a first drawstring stop and a second drawstring stop;

wherein the first drawstring stop extends from the first limb or the handle and a face of the first drawstring stop is located within a path of the drawstring when the drawstring is released from a drawn position;

wherein the second drawstring stop extends from the second limb or the handle and a face of the second drawstring stop is located within a path of the drawstring when the drawstring is released from a drawn position.

13. The sling bow of claim 11, wherein the first drawstring guide comprises a first roller and the second drawstring guide comprises a second roller.

14. The sling bow of claim 13, wherein the first roller defines a portion of the first drawstring void and the second roller defines a portion of the second drawstring void.

15. The sling bow of claim 11, wherein a longitudinal axis of the first limb and a longitudinal axis of the handle form an angle of between 90 degrees and 180 degrees; and wherein a longitudinal axis of the second limb and the longitudinal axis of the handle form an angle of between 270 degrees and 360 degrees.

16. The sling bow of claim 11, wherein the first elastic portion and the second elastic portion comprise a material with a modulus of elasticity of at least 0.01 GPa and not more than 0.2 GPa.

17. The sling bow of claim 11, wherein the drawstring has a length that is at least 1.5 times longer when the drawstring is in a drawn position compared to the length when the drawstring is in the non-drawn position.

18. The sling bow of claim 11, wherein the first drawstring guide void and the second drawstring guide void are located at least 4 inches apart.

19. A sling bow, comprising:

a handle;

a first limb comprising a distal end and a proximal end, wherein the proximal end is coupled to the handle;

a second limb comprising a distal end and a proximal end, wherein the proximal end is coupled to the handle;

a drawstring comprising a first elastic portion, a second elastic portion, and a non-elastic portion between the first and second elastic portions, wherein a first end of the first elastic portion is coupled to the distal end of the first limb and a first end of the second elastic portion is coupled to the distal end of the second limb;

a first drawstring guide, wherein the first drawstring guide defines a first drawstring void, wherein the drawstring extends through the first drawstring void; and a second drawstring guide, wherein the second drawstring guide defines a second drawstring void, wherein the drawstring extends through the second drawstring void;

wherein the drawstring contacts the first drawstring guide and the second drawstring guide when the drawstring is in a drawn position;

wherein the first limb and the second limb are configured to elastically deform when the drawstring is brought into a drawn position;

wherein the first drawstring guide and the second drawstring guide are located rearward from the handle.

20. The sling bow of claim 19, further comprising a first drawstring stop and a second drawstring stop;

wherein the first drawstring stop extends from the first limb or the handle and a face of the first drawstring stop is located within a path of the drawstring when the drawstring is released from a drawn position;

wherein the second drawstring stop extends from the second limb or the handle and a face of the second drawstring stop is located within a path of the drawstring when the drawstring is released from a drawn position.

* * * * *